United States Patent [19]

Koser et al.

[11] 4,220,028

[45] Sep. 2, 1980

[54] METHOD AND DEVICE FOR PRODUCING TUBE BENDS

[75] Inventors: Rolf Koser, Espelkamp-Frontheim; Egon Haberstock, Oberbauerschaft; Anton Breidenbend, Bünde; Manfred Wonderschütz, Kirchlengern, all of Fed. Rep. of Germany

[73] Assignee: SIDRO GmbH & Co. Ludwig Möller, Bünde 1, Fed. Rep. of Germany

[21] Appl. No.: 901,482

[22] Filed: May 1, 1978

[51] Int. Cl.[2] ..... B21D 3/14

[52] U.S. Cl. ..... 72/117; 72/369; 72/398; 72/122; 113/116 UT

[58] Field of Search ..... 29/157 A, 157.6; 113/116 UT; 72/369, 367, 370, 152, 117, 122, 398

[56] References Cited

U.S. PATENT DOCUMENTS

| | | | |
|---|---|---|---|
| 816,451 | 3/1906 | Forwood | 72/122 |
| 2,740,455 | 4/1956 | Veatch | 29/157 A |
| 3,335,485 | 8/1967 | Russo | 29/157 A |
| 3,919,875 | 11/1975 | Maev et al. | 72/369 |

FOREIGN PATENT DOCUMENTS

| | | | |
|---|---|---|---|
| 453786 | 1/1959 | Canada | 72/370 |

*Primary Examiner*—Lowell A. Larson
*Attorney, Agent, or Firm*—Herbert L. Lerner

[57] ABSTRACT

Method of producing tube bends of a given diameter and substantially uniform wall thickness from a straight tube having a diameter smaller than the given diameter, which includes re-shaping at least one end of the straight tube with a work-tool to form tangentially directed cylindrical leg extensions of equal tube bend cross section.

12 Claims, 33 Drawing Figures

METHOD AND DEVICE FOR PRODUCING TUBE BENDS

The invention relates to a method for producing tube bends wherein, from a straight tube of lesser diameter, a tube bend of a larger diameter and uniform wall thickness is produced.

In the German Patents DE-PS 367 518; 583 550 and 573 890, a method for the production of tube bends is described wherein, from a straight tube of lesser diameter, a tube bend with larger diameter and uniform wall thickness is produced. According to this method, the straight tube is expanded by sliding it over a taper plug in such a manner that a tube bend with a round cross-section is generated.

Tube bends produced by the known method are uniformly curved throughout. However, in the metal industry tube bends with straight leg-extensions are frequently required which are produced by welding short tubes to the finished tube bends. For high quality requirements, the welding seams have to undergo an after-treatment which can be costly, depending on the quality required.

The purpose of the invention of the instant application is to overcome the disadvantages of the present manufacturing method of producing tube bends with welded tube extensions and to produce the same product in one piece.

It is therefore an object of the invention to overcome the hereinaforementioned shortcomings of the heretofore known methods and devices of this general type and to provide a method and device with which tube bends with tangentially extending, cylindrical leg portions can be produced in one piece with mechanical means.

With the foregoing and other objects in view, there is provided, in accordance with the invention, a method of producing tube bends of a given diameter and substantially uniform wall thickness from a straight tube having a diameter smaller than the given diameter, which comprises re-shaping at least one end of the straight tube with a work-tool to form tangentially directed cylindrical leg extensions of equal tube bend cross section.

The essential advantage of the new method is that a completely new product can now be produced which can also be manufactured at a considerably lower price than the tube bends with welded end tubes as they were made previously.

The method for the production of one piece tube bends with tangentially extending cylindrical leg portions according to the invention includes various differentiated operational steps which by themselves are variable.

In accordance with another mode of the invention, the re-shaping of the straight tube end is effected with a mandrel as the work-tool.

In accordance with a further mode of the invention, at least one extension is reshaped stepwise.

In accordance with an added mode of the invention, at least one extension is reshaped in continuous motion.

In accordance with an additional mode of the invention, the reshaping of the straight tube end is effected with a die as the work-tool.

In accordance with yet another mode of the invention, the extension is pre-formed in a vertical die and subsequently finish-formed in an horizontal die.

In accordance with a still further mode of the invention, at least one extension is formed by rolling.

In accordance with an alternate mode of the invention, at least one leg extension is formed by inserting a work-tool inside the tube and expanding the work-tool against another work-tool disposed outside the tube.

In accordance with the device of the invention for performing the foregoing method, there is provided a device for performing the method of producing tube bends of a given diameter and substantially uniform wall thickness from a straight tube having a diameter smaller than the given diameter, comprising means for reshaping end portions of tube bends to form cylindrical leg extensions with equal cross sections, the re-shaping means being at least one means chosen from the group consisting of tube pressing means and tube sizing means.

In accordance with another feature of the invention the re-shaping means are in the form of means for stepwise spirally drawing a tube bend, comprising a pattern plate disposed at the outer edge of a portion of a tube bend to be re-shaped and a moveable punch disposed opposite the pattern plate.

In accordance with a further feature of the invention the reshaping means is operable stepwise and includes two moveable tool-jaws and a plurality of pressure rollers operatively connected to the tool-jaws for controlling the size of the inner wall of the extension.

In accordance with an additional feature of the invention, the pressure rollers are disposed in a fixed position between the jaws and serve to support and shape the extension.

In accordance with an added feature of the invention, there is provided a common drive for all of the pressure rollers.

In accordance with yet another feature of the invention, the pressure rollers are disposed about an imaginary circle, and including a common drive for all of the pressure rollers, the drive being slidable along the axis of the extension.

In accordance with yet a further feature of the invention, the pressure rollers are slidably mounted and disposed about a common support roller.

In accordance with yet an additional feature of the invention, the re-shaping means comprises one moveable and one fixed press-jaw disposed outside a tube bend to be re-shaped, and a mandrel insertable within the tube bend.

In accordance with yet an added feature of the invention, the fixed jaw includes arc-shaped means for supporting the tube bend.

In accordance with another feature of the invention, the punch includes profiled protrusion means integral therewith for shaping the inner walls of a tube bend inserted between the punch and the pattern plate.

In accordance with a further feature of the invention, there is provided two forming-jaws between which a tube bend end is insertable, and mandrel means for controlling size and re-shaping of the tube bend end.

In accordance with an additional feature of the invention, there is provided a plurality of pressure rollers moveably mounted on a driven rotating disc, the pressure rollers being disposed so as to act simultaneously on the inner and outer wall of a tube bend.

In accordance with an alternate feature of the invention, the pressure rollers are disposed on shafts which are secured in bearings adjustably positioned on the rotating disc.

In accordance with another feature of the invention, there is provided means for driving the pressure rollers.

In accordance with a further feature of the invention, there is provided means for commonly driving the rotating disc and the pressure rollers.

In accordance with an additional feature of the invention, the re-shaping means comprises a fixed press-jaw operatively connected to a moveable press-jaw, and a semicircular profiled punch rigidly attached to the moveable jaw.

In accordance with an added feature of the invention, there is provided a forming die and clamping means for pressing an end of a tube bend into the forming die, the pressing means being swingable about a fixed axis.

In accordance with yet another feature of the invention, there is provided a fixed clamping device into which a tube bend is insertable, and two devices for finish-forming protruding ends of the tube bend, the finish-forming devices being swingable about a fixed axis.

In accordance with yet a further feature of the invention, there is provided a slidable pressure roller, a fixed clamping groove opposing the sliding of the pressure roller and spaced therefrom so as to allow a tube portion to be insertable therebetween, and slidable mandrel means for calibrating the size of the extension.

In accordance with yet an additional feature of the invention, there is provided a fixed and a moveable clamping jaw and expandable mandrel means associated with the clamping jaws for dimensioning the inside of the extension.

In accordance with yet an added feature of the invention, there is provided another fixed and another moveable clamping jaw, the other fixed and moveable clamping jaws being disposed at an adjustable angle to the first-mentioned fixed and moveable clamping jaws, and another mandrel means associated with the other clamping jaws, the first-mentioned and other mandrel means being slidable into and out of the tube bend.

In accordance with an alternate feature of the invention, there is provided vertically disposed die means for producing an oval cross-sectional extension, and horizontally disposed die means for producing a cylindrically shaped extension.

In accordance with a still further feature of the invention, at least one of the die means includes a moveable upper part and a fixed lower part, the parts having pressure surfaces profiled in the shape of a tube bend and including extension-forming segments integral with the pressure surfaces.

Other features which are considered as characteristic for the invention are set forth in the appended claims.

Although the invention is illustrated and described herein as embodied in method and device for the production of tube bends, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
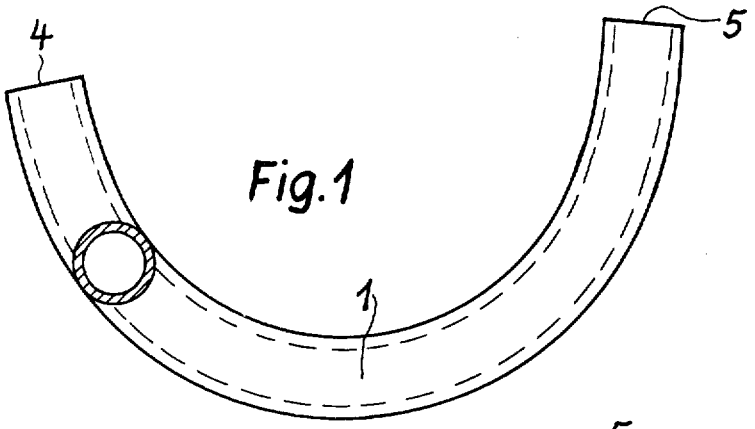
FIG. 1 is a diagrammatic plan view of a tube bend with uniform cross section.

Referring now to the figures of the drawing and first, particularly, to FIG. 1 thereof, there is shown a product of the conventional method for production of tube bends wherein from a tube of lesser diameter a tube bend 1 with a larger tube diameter and uniform wall thickness is produced. Through the use of this heretofore known method, only tube bends which are uniformly curved and expanded in all cross section can be made.

Figure 2:
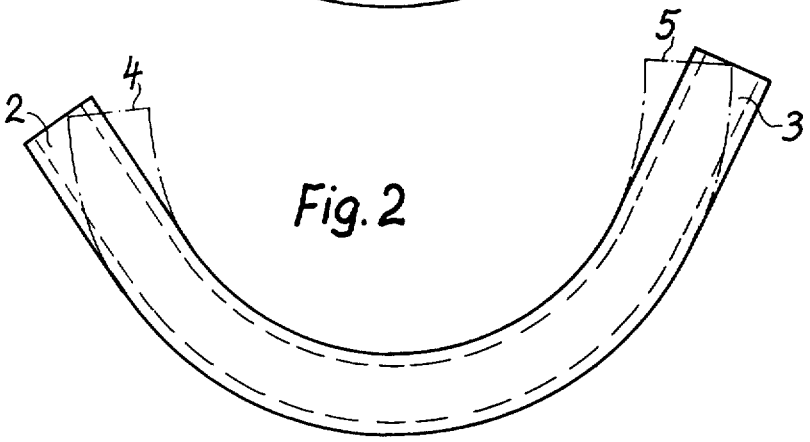
FIG. 2 is a view similar to that of FIG. 1 of a tube bend with leg extensions at both ends thereof.

In order to produce tube bends with tangentially directed cylindrical leg extensions 2, 3 as shown in FIG. 2, the ends of the tube 1 undergo further work stages according to the invention of the instant application. The forming operations which are required in such a case can be performed with the tube bend 1 in either a cold or a hot state. In order to keep the forming forces low and to avoid disadvantageous cold-hardening, it is prefereable, in some cases, to use the hot forming process.

The following detailed explanation of various modes of the method of the invention all have as a common objective the solution of the same geometrical problem, which is to bring the ends 4, 5 (FIG. 1) of a tube bend into a cylindrical form of equal cross-sectional measurement.

In the step-method the reforming of the tube ends 4, 5 is effected in steps. Each tube end 4, 5 is pressed continuously and with a predetermined feeding motion into the respective work-tool. Each tube-bend end must be worked on separately. The length of the leg-extensions 2, 3 (FIG. 2) must be taken into account when making the tube bend 1.

Figure 3:
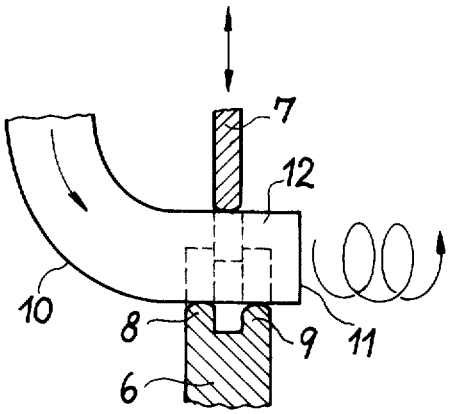
FIG. 3 is a diagrammatic partially cross-sectional view of a tube bend and a progressive (step-wise working ) device for shaping the ends of a tube bend by means of punch and die.

In the step-method the reforming of the ends 4, 5 of the tube bend is effected by choice using the following devices: on the table of a conventional eccentric press a pattern-plate 6 (FIG. 3) is mounted. The pattern-plate 6 works in conjunction with a moveable punch 7 which is moved up-and down with high speed by the eccentric. The pattern plate 6 has an approximately U-shaped cross section and its flanks 8, 9 are rounded at their upper edge. The tube bend 10 to be worked on, starting with its tube end 11, is inserted into the tool evenly pushing and turning so that a sprial-like forward motion is generated. The shaping is effected in steps in rapid succession by the punch 7 and the suitably shaped pattern-plate 6.

At the end of the operation, a leg extension 12 shows the form of a cylinder of uniform cross section.

Figure 4:
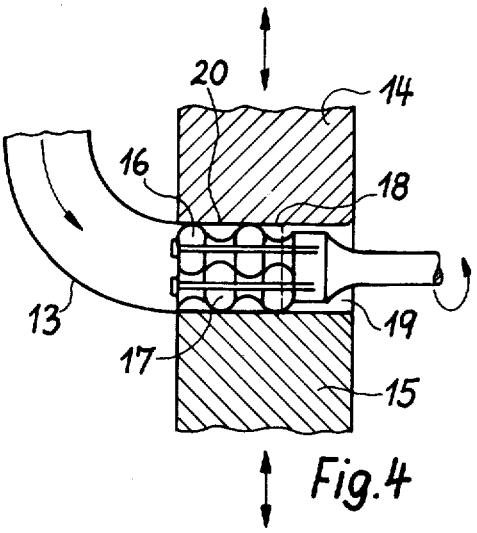
FIG. 4 is a diagrammatic partially cross-sectional view of a tube bend and a stepwise working device for shaping the ends of a tube bend by means of inside-rollers.

A further development for the stepwise manufacture of tube bends with leg extensions results from the use of pressure rollers which are applied at the inside of the tube bend and work together with a split outer die. In FIG. 4, a diagrammatic view of such a device is shown. A tube bend 13 is inserted step-by-step between two moveable jaws 14, 15 which open and close in short time intervals. Between the two forming-jaws 14, 15 are rotating pressure rollers 16, 17 which, for example, can be constructed so as to function alternatingly as work- and support rollers and can be driven by a motor. The pressure rollers 16, 17 form the end of the tube 18 of tube end 13 into a cylindrical tube-leg extension 20 by pressing the forming jaws 14, 15 onto the cylindrical inner space 19.

Figure 5:
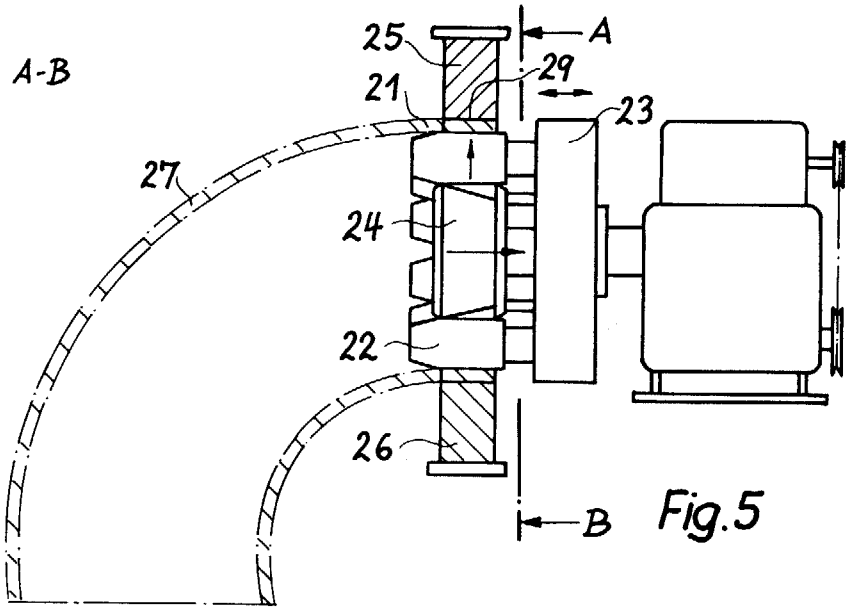
FIG. 5 is a diagrammatic partially cross-sectional view of a tube bend and a device working with circularly disposed pressure rollers.
Figure 6:
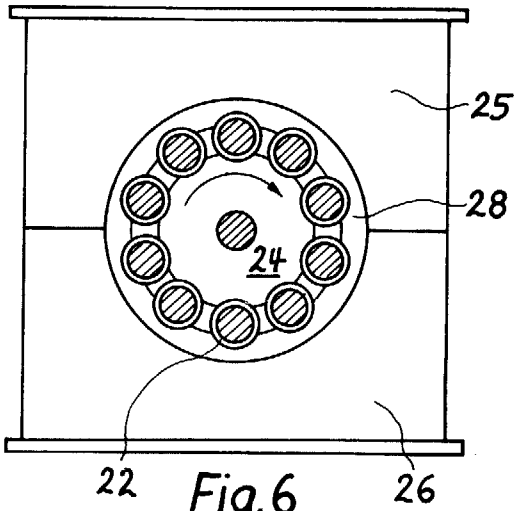
FIG. 6 is a sectional view taken along line A–B in FIG. 5 in the direction of the arrows.

For large tube cross sections, the pressure rollers 21, 22 according to FIG. 5 and 6 can be disposed in a circle and can be motor-driven by a planetary gear train 23. A central support roller 24 which is adjustable, supports the pressure rollers 21, 22. Of the two pressure jaws 25, 26, pressure jaw 25 is moveable. The tube bend 27 is gripped between the pressure jaws 25, 26 and worked by pressure rollers 21 and 22 which are continuously driven and slowly pushed inwardly, the cylindrical shape of the pressure-jaws 25, 26 controlling the tube cross section of the leg extension.

Figure 7:
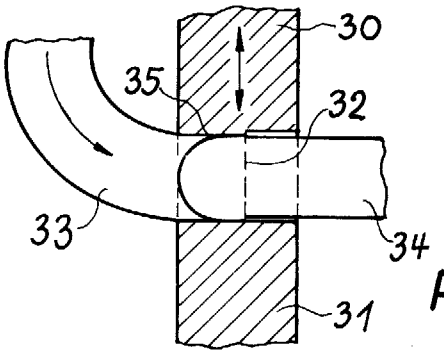
FIG. 7 is a diagrammatic partially cross-sectional view of a tube bend and a stepwise working device for shaping the ends of a tube bend by means of a mandrel.

For especially small tube cross sections, the device shown in FIG. 7 is used.

Two jaws of the tool 30, 31, which move up and down, grip the end 32 of the tube bend 33 which has been inserted into the jaws. A mandrel 34 is inserted into the tube bend end 32 stepwise. After this operation, the jaws 30, 31 open and the mandrel 34 together with the tube bend 33 is moved a distance to the right-hand side, as viewed in FIG. 7. After this motion to the right, the jaws 30, 31 reclose, and the mandrel 34 is pushed in to the left-hand side of FIG. 7, a distance equal to the motion to the right. These actions are repeated until the required leg extension 35 is produced.

Figure 8:
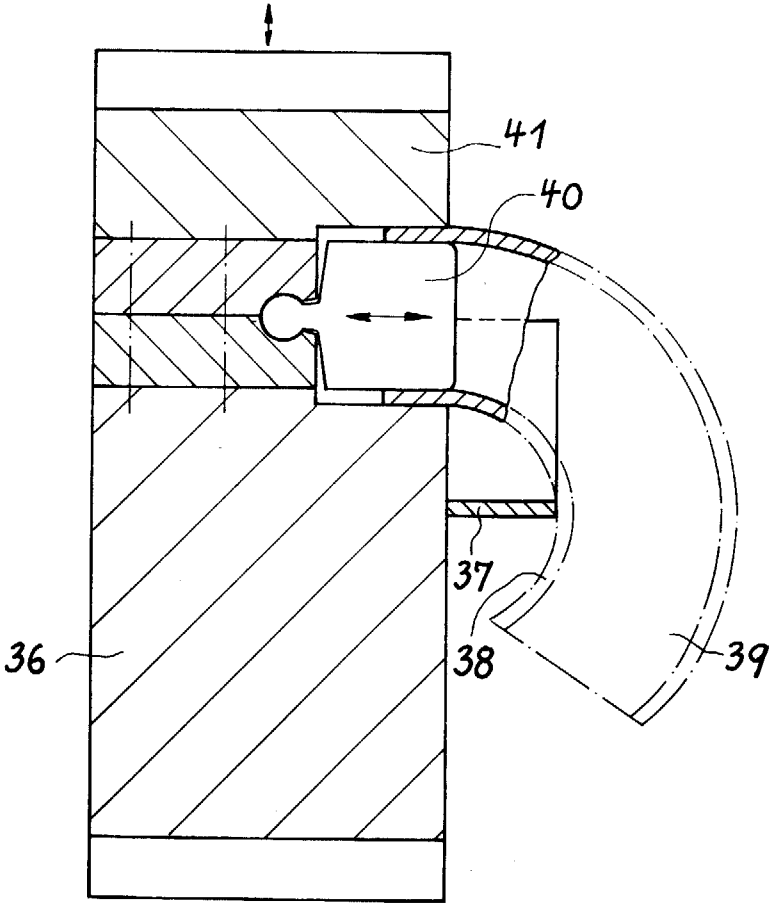
FIG. 8 is a diagrammatic partially cross-sectional view of a tube bend and a device for forming leg-extensions with an arc-shaped support and working with a mandrel.
Figure 9:
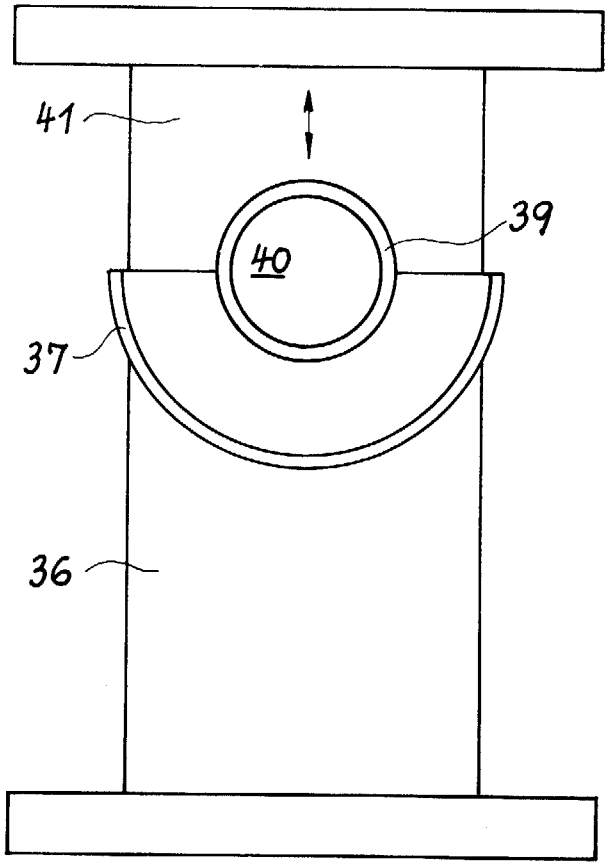
FIG. 9 is a plan view of FIG. 8.

For narrow tube bends, the object of the invention is best served by providing one of the tool-jaws 36 (FIGS. 8 and 9) with a semi-circular support 37, the height of which in some cases can be made adjustable. This support 37 serves to carry the inner edge 38 of a curved tube bend 39 which is worked by means of a moveable mandrel 40 and a jaw 41 which moves up and down.

Figure 10:
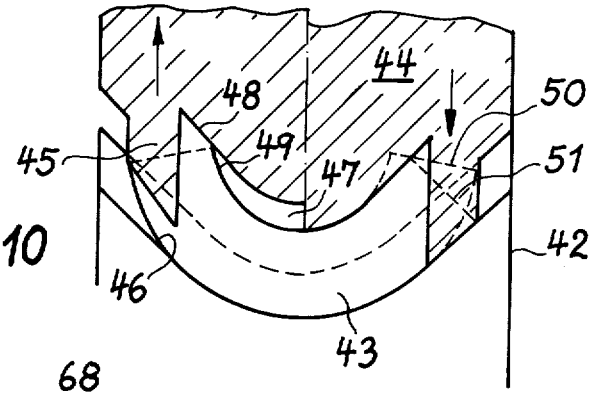
FIG. 10 is a diagrammatic partially cross-sectional view of a tube bend and a device provided with a moveable punch and a die-plate, the punch showing two nose-shaped side protrusions.

For small leg extensions and small tube cross sections, the method is carried out with a stroke-like operating press tool as shown in FIG. 10, which effects the reforming in one stroke. This press tool includes a die-plate 42 which is formed to receive a tube bend 43 that is inserted with its tube ends pointing upwardly. The punch 44, which works in conjunction with the die plate 42, has protrusions 45 on both sides thereof which work during the press action on the inner contours 46 of the radially outer wall of the tube bend 43. Besides the protrusions 45, forming zones 48 are provided in the inner space 47 of punch 44. The forming zones 48 apply pressure onto the outer contours 49 of the radially inner wall of the tube bend 43 during the press action. As can be seen from FIG. 10, on the left-hand side of the dot-dash line the punch 44 is shown in its opening position and must be moved so far up that the tube bend 43 can be inserted without interference and be removed after the reforming operation is effected. On the right-hand side of the dot-dash line in FIG. 10, the punch 44 is in the press-position. As can be seen, the press-position of the punch 44 has caused the end 50 of the tube bend to be reformed to a cylindrical leg extension 51.

Figure 11:
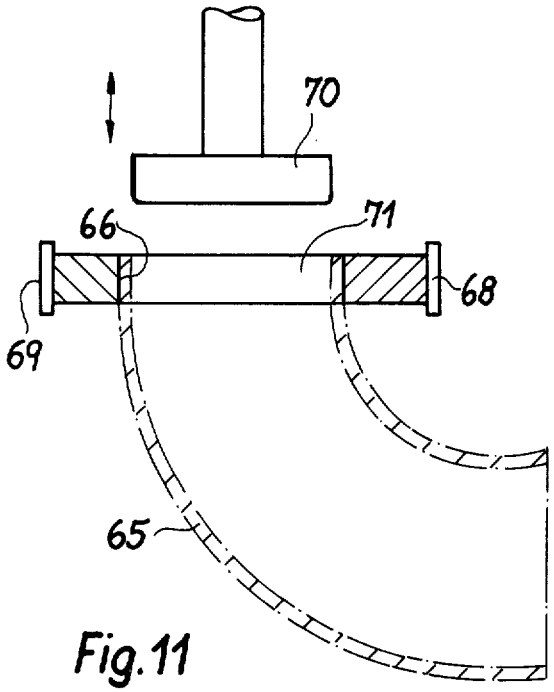
FIG. 11 is a diagrammatic partially cross-sectional view of a tube bend and a device suitable for producing short leg extensions using a stamping punch.
Figure 12:
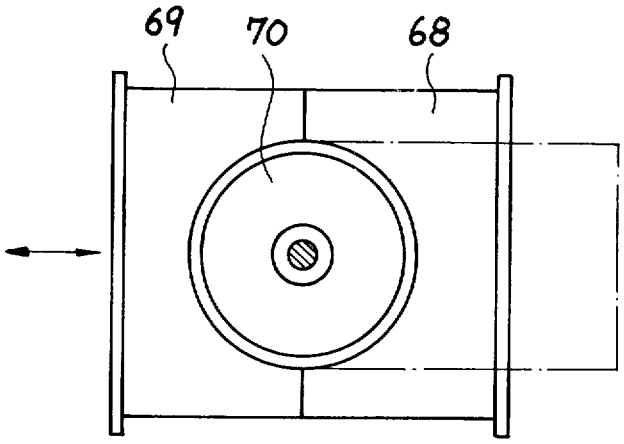
FIG. 12 is a plan view of FIG. 11.

Thick-walled tube bends 65, according to FIG. 11, which are to be provided with relatively short leg extensions 66 can be produced with the press device shown in FIGS. 11 and 12.

The press-device includes a fixedly-mounted press jaw 68 and a moveable punch 70. The punch 70 is inserted into the end 71 of the tube bend 65 in which the work is to be done. Then the tube bend 65 with its end 71 and the punch 70 is placed between the press jaws 68, 69. By closing the cylindrical press jaws 68,69, the reforming into a leg extension is effected.

Figure 13:
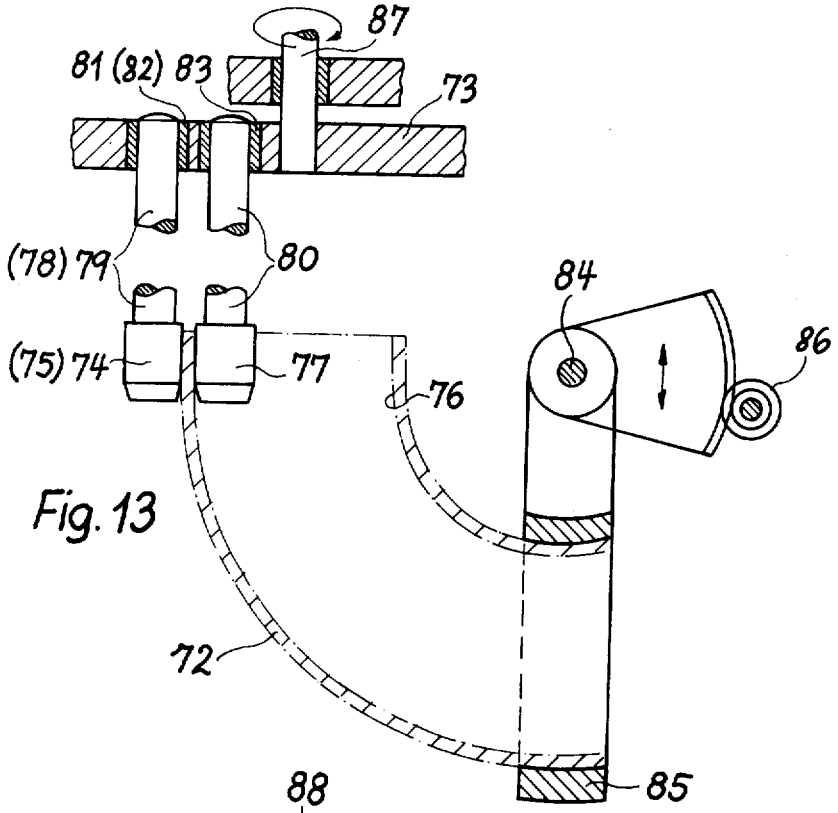
FIG. 13 is a diagrammatic partially cross-sectional view of a tube bend and a roll-forming device for longer tube-leg extensions.

Large tube bends 72, as shown in FIG. 13, can be produced by means of rotating pressure rollers. For this purpose, two motor driven pressure rollers 74, 75 (FIG. 13) acting on the outside of the tube bend 72 are mounted on a rotating plate 73 which act at the outer circumference of the securely clamped tube bend 72 from its opening toward the inside. Roller 75 is disposed behind roller 74 in FIG. 13 and therefore is not shown. The pressure roller 77 which acts on the inner wall-surface 76 between the two pressure rollers 74, 75 presses the material to be formed against the pressure rollers 74, 75 which act at the radially outer wall-surface of the bend.

The pressure rollers 74,75 and 77 are rotatably disposed on shafts 78 to 80, respectively, which are secured in bushings 81 to 83, respectively, in the rotating plate 73. The bushings 81 to 83 are rotatable in the rotating plate 72 and are secured by holding means which are not shown in proper adjusted position. Through their eccentric mountings, the pressure rollers 74, 75 77 can not only be adjusted for precisely predetermined wall thicknesses, but can also be used within a limited adjustment range for working on larger tube bend diameters. For this purpose the tube bend 72 is guided by a clamping device 85 which is rotatable around a shaft 84. A drive 86, which is provided for the clamping device 85, may in some cases be machine activated. The pressure rollers 74, 75, 77 can also be moved axially within a limited adjustment range by means of the rotating plate 73, which has a longitudinally moveable drive shaft 87.

Figure 14:
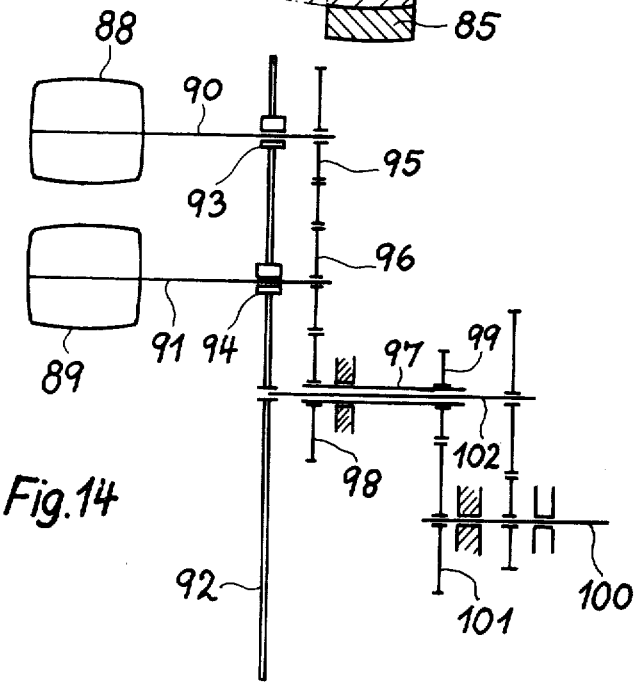
FIG. 14 is a schematic view of the machine drive of the pressure rollers for the roll-forming device.

Obviously, the pressure rollers can also have their own drive. For this purpose, the machine-driven pressure rollers 88, 89, according to FIG. 14, are secured to shafts 90, 91 which are supported in the adjustable eccentric bearing bushings 93, 94 in a rotatable plate 92, and permit small adjustments. Special toothed spur gears 95, 96 which mesh with each other, are disposed on shafts 90,91. One spur gear 96 mates with a second spur gear 98 which is secured to a hollow shaft 97. Fixed to the hollow shaft 97 is another gear 99 which meshes with a gear 101 that is seated on a drive shaft 100. The hollow shaft 97 is disposed on a shaft 102 which carries the rotatable plate or disc 92. The shaft 102 is also driven by drive shaft 100 through a gear train as shown.

The rotary speed of the pressure rollers 88, 89 and of the disc 92 can easily be adapted to particular requirements by the transmission ratios of the gear drives.

Figure 16:
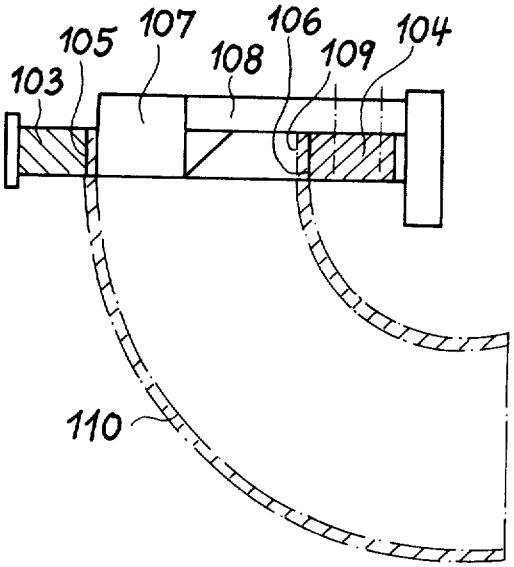
FIG. 16 is another partially sectional view of the stamping device of FIG. 15.
Figure 15:
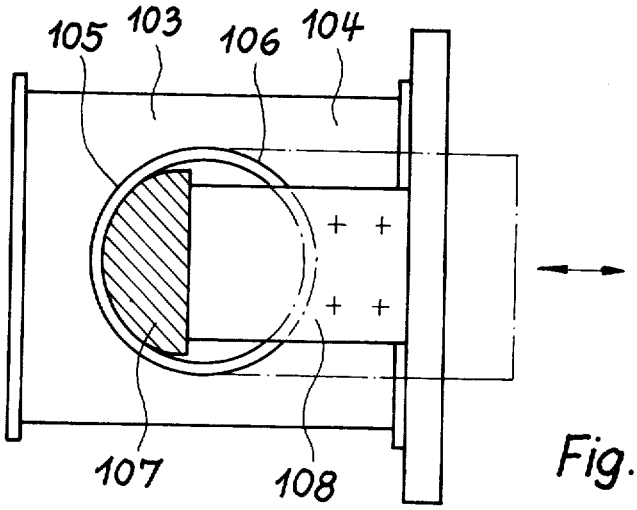
FIG. 15 is a diagrammatic partially sectional plan view of a tube bend and a stamping device with the punch disposed in a fixed position.

Extremely long leg extensions are achieved with the device shown in FIG. 15 and 16.

This device includes a fixed jaw 103 (see also FIG. 16) which works in conjunction with a moveable jaw 104.

The jaws 103 and 104 of the tool have semicircular press-profiles or working surfaces 105, 106 which, together with a semicircular punch 107, a supporting arm 108 of which is securely fixed to the moveable jaw 104, shape the inserted portion 109 of a tube bend 110 to a straight form.

Figure 17:
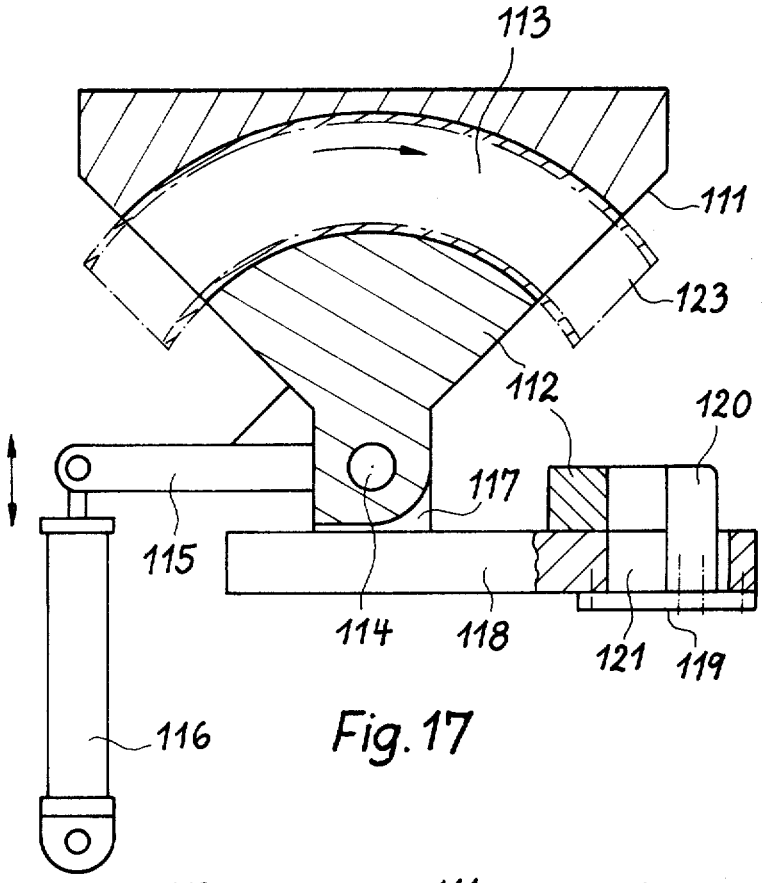
FIG. 17 is a diagrammatic partially cross-sectional view of a device suitable for producing short or long leg-extensions in tube bends with any cross section.
Figure 18:
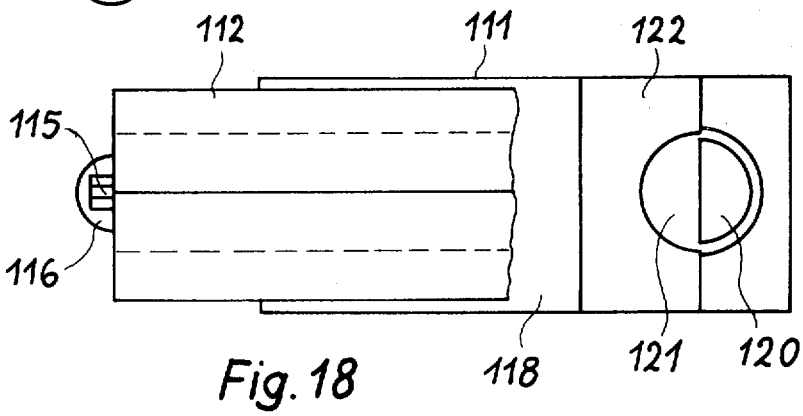
FIG. 18 is a plan view of FIG. 17.

FIGS. 17 and 18 show a device 111 which is suited for smaller as well as larger leg extensions. This device 111 is formed of a two-part clamping jaw 112 into which a tube bend 113 is inserted and securely clamped. The clamping jaw 112 is seated on a shaft 114, and is hinged around the shaft 114 by means of its arm 115 which is adjustable by an hydraulic drive 116. The shaft 114 is disposed in a bearing or support lug 117 of a press-tool 118 which is solidly supported locally and provided with a support plate 119. On the support plate 119, a fixed semicircular mandrel 120 is seated which extends into a cylindrically formed bore 121 of the press-tool 118. On the inside thereof, a semicircularly cutout form-block 122 is provided. The extending portion 123 of the tube bend 113 is pulled over the mandrel 120 during the press operation and brought to a cylindrical form by the action of the form block 122 with the cylindrical bore 121 of the press tool 118.

Figure 21:
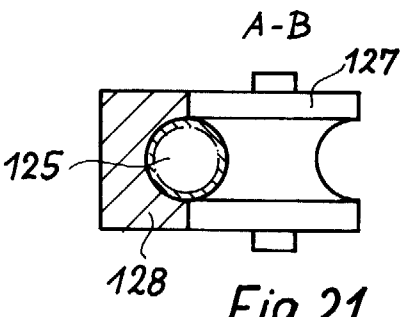
FIG. 21 is a partially cross-sectional view of a fragment of the device shown in FIG. 19, taken along the line A–B in the direction of the arrows.
Figure 19:
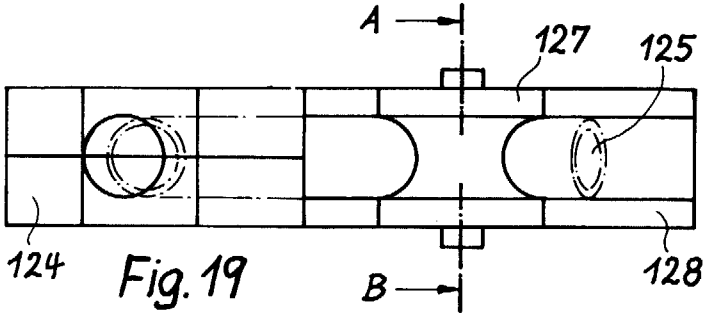
FIG. 19 is a diagrammatic plan view of a tube bend and a device for rolling leg extensions followed by sizing by means of a mandrel.
Figure 20:
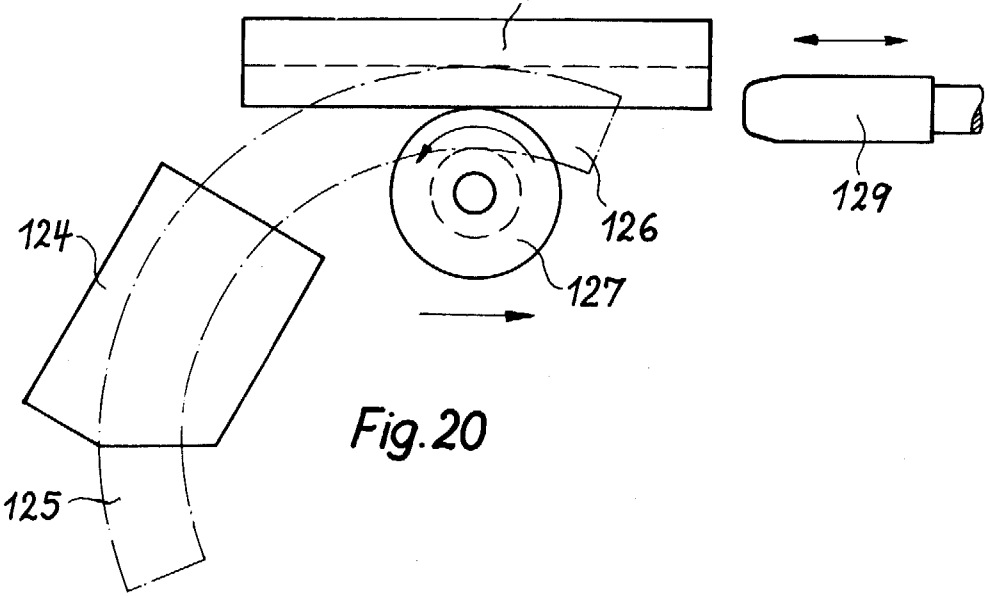
FIG. 20 is an elevational view of FIG. 19.

The device shown in FIGS. 19 to 21 is also useable for producing longer leg extensions. This device essentially includes a fixed clamping jaw 124 which is partially split and serves for clamping a tube bend 125. A pressure-roller 127 rotates in the direction of the curved arrow in FIG. 20 and is moved by suitable transport means from the starting position shown in FIG. 20 along the straight arrow shown towards the tube end. The pressure roller 127 works in conjunction with an opposing, fixedly positioned groove 128 and presses the curved tube portion 126 into a straight shape during the rolling operation. In the end position of the pressure roller 127, a mandrel 129 which is moving in a straight line is inserted into the generated leg extension for the required sizing of the inside thereof and to accurately straighten the leg extension.

Figure 23:
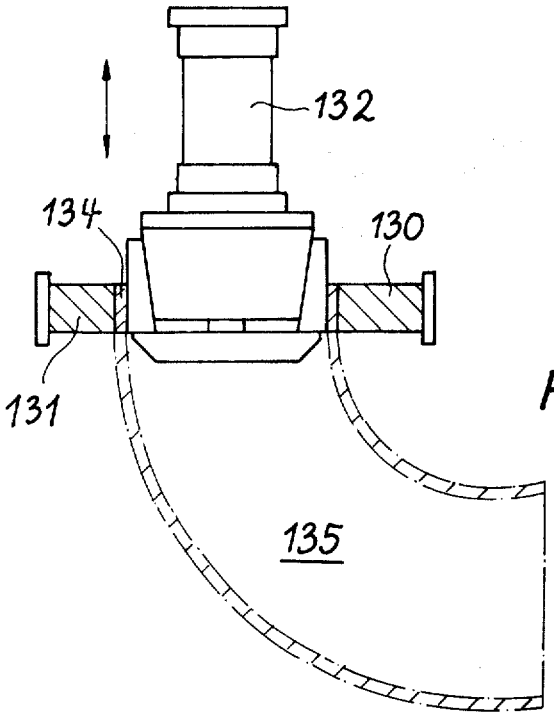
FIG. 23 is a partially cross-sectional view of the device of FIG. 22.
Figure 22:
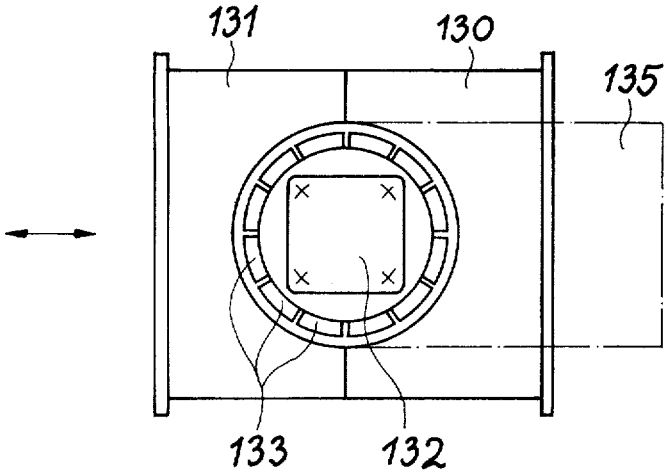
FIG. 22 is a diagrammatic plan view of a tube bend and a device working with an expanding mandrel.

For large caliber bends which exhibit relatively large wall thicknesses, the device shown in FIGS. 22 and 23 is suitable. The device includes a fixed clamping jaw 130, a moveable clamping jaw 131, and an axially moveable expandable mandrel 132 which is provided with expansion segments 133. The portion of a tube bend 135 which is intended as a leg extension 134 is placed between the clamping jaws 130, 131 and, after the clamping operation, the expandable mandrel is pressed in.

The above-described construction is particularly suited for the simultaneous manufacture of leg extensions on both ends of a tube bend.

Figure 25:
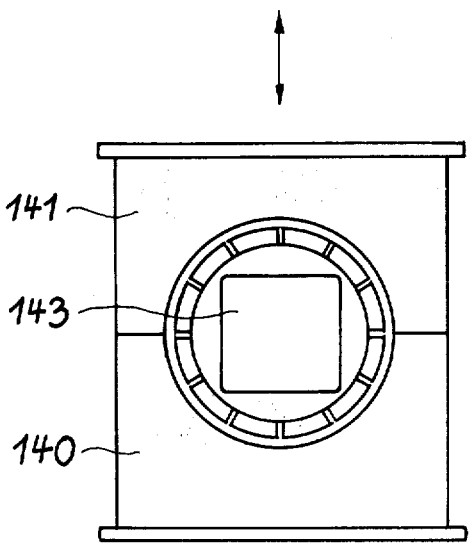
FIG. 25 is a front elevational view of the device of FIG. 24.
Figure 26:
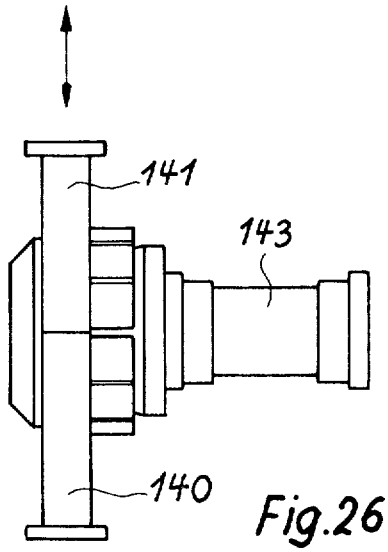
FIG. 26 is a side elevational view of the device of FIG. 24.
Figure 24:
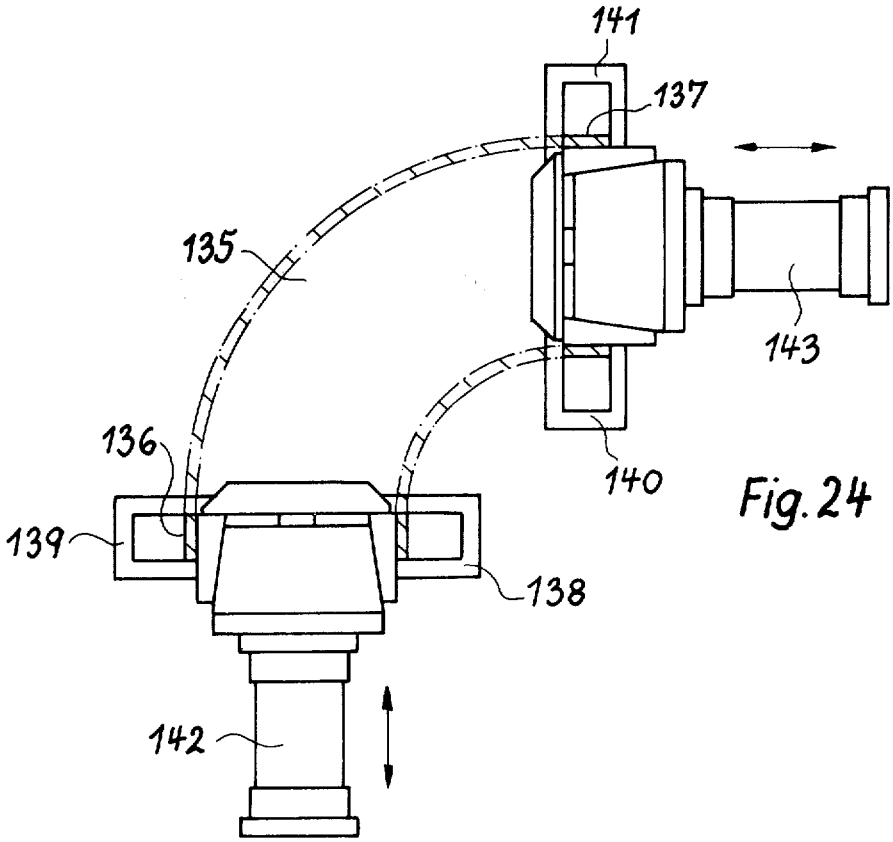
FIG. 24 is a diagrammatic partially sectional plan view of a tube bend and a device suitable for forming both ends of a tube bend simultaneously with expansible punches.
Figure 28:
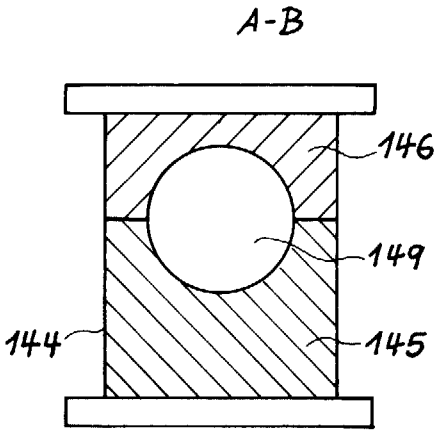
FIG. 28 is a sectional view taken along line A–B in FIG. 27 in the direction of the arrows.
Figure 27:
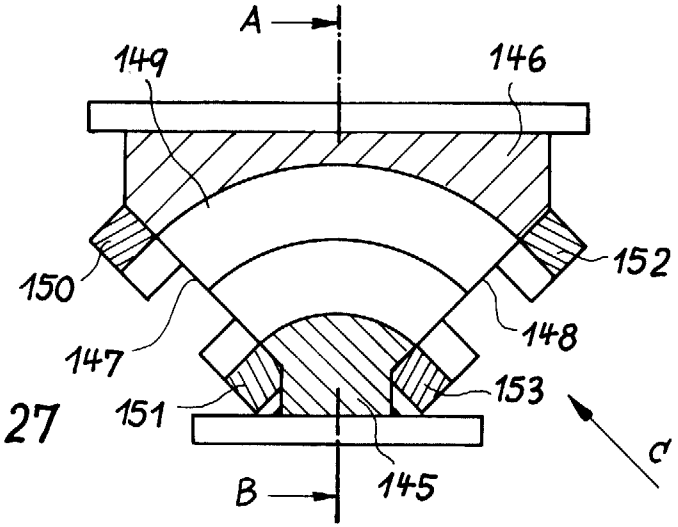
FIG. 27 is a diagrammatic partially cross-sectional view of a device constructed as a stamping die (press-tool) for the simultaneous forming of the tube bend and its two leg extensions.
Figure 29:
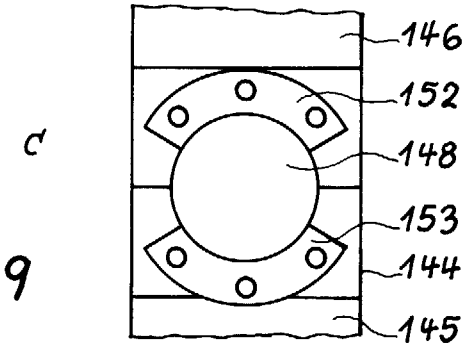
FIG. 29 is a view of FIG. 27 taken in the direction of arrow C.

As can be seen from FIGS. 24 to 26, a tube bend 135 is securely clamped in two clamping jaw pairs 138, 139 and 140, 141. The ends of the tube bend 135 are intended to be leg extensions 136, 137, the clamping jaws being disposed in orthogonal or other angular position relative to each other. In this case again, one of the clamping jaws 139 or 141, respectively, is moveable and the other one 138 or 140, respectively, is disposed arranged in a fixed position.

The slidable expansion mandrels 142, 143, respectively, which are disposed in a transverse direction with reference to the clamping jaw pairs 138, 139 and 140, 141 are simultaneouwly pressed into the tube ends of the clamped tube bend 135 and thereby generate the two leg extensions in conjunction with clamping jaw pairs 138, 139 and 140, 141, respectively.

Figure 30:
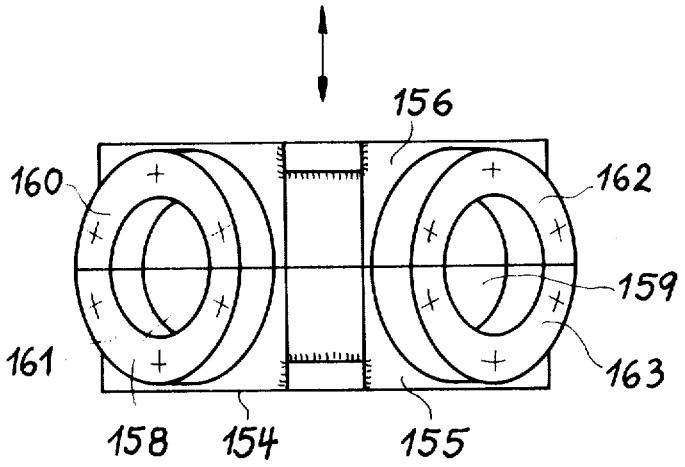
FIG. 30 is a diagrammatic front-elevational view of a die formed of an upper and lower part for simultaneously forming a tube bend with oval end cross-section and two leg extensions.
Figure 31:
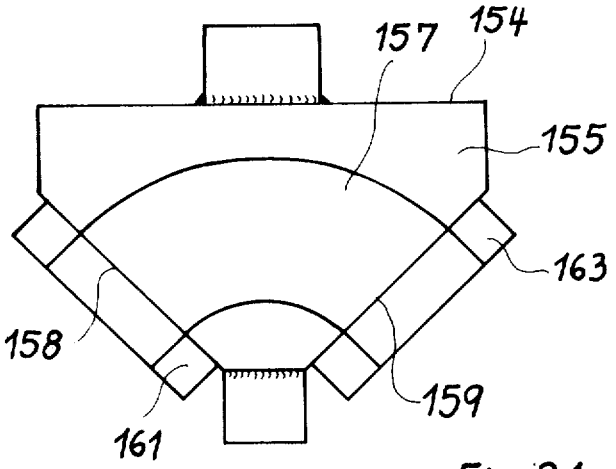
FIG. 31 is a plan view of the lower part of the die of FIG. 30.

The device shown in FIGS. 27 to 31 is suited for forming two-sided leg extensions of small tube bends. The device includes a two-part vertical die 144 (FIGS. 27 to 29) and a two-part horizontal die 143 (FIGS. 30 and 31). At the openings 147, 148, arc shaped form segments 150, 151 and 152, 153 are provided on the upper and lower part 146, 145, respectively, which shape the ends of the inserted tube bend to straight oval leg extensions during the press action.

To obtain a cylindrical leg extension, the tube bend is thereafter placed in the horizontal die 154 (FIGS. 30 and 31). The shaping is effected by the ring-shaped form elements 160 to 163 which are provided at the openings 158 and 159 of the tube bend-like holder 157.

Figure 32:
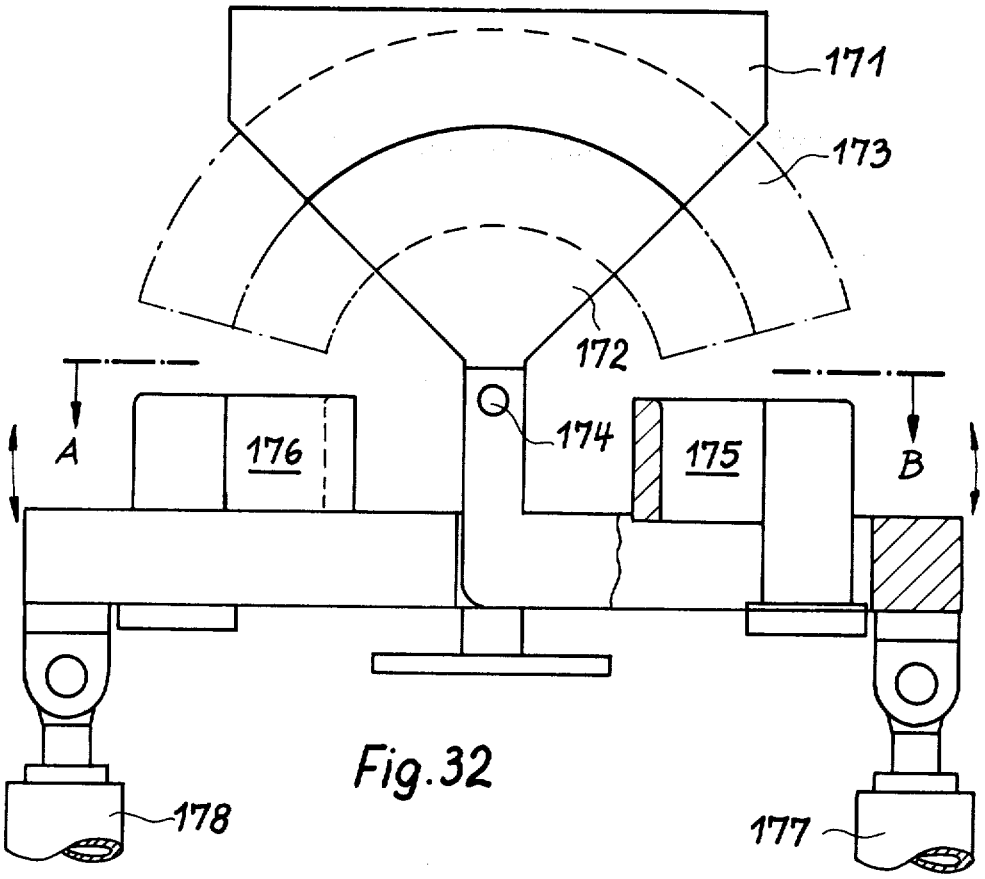
FIGS. 32 and 33 are further embodiments of the device of FIG. 17.
Figure 33:
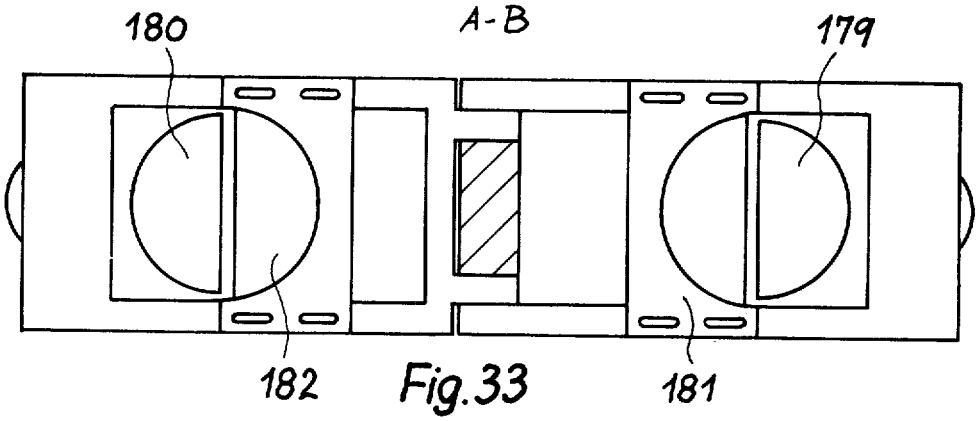

The device shown in FIGS. 32 and 33 permits the simultaneous manufacture of leg extensions at both ends of a tube bend. This device includes a two-part clamping jaw 171, 172, in fixed position, into which a tube bend 173 is inserted and securely clamped. Arms 175 and 176 are pivoted on a fixed pin. On the arms, press-tools are mounted which can be pivoted around the pin 174 by hydraulic drives 177, 178 respectively. These press-tools each include a semicircular-shaped mandrel 179, 180, respectively, and each have a semicircular cut-out forming-die or block 181, 182, respectively. When the pressing tools are hinged upwardly the protruding portions of the tube bend 173 are drawn over mandrels 179, 180 during the pressing operation and given a final cylindrical shape by forming dies 181, 182, respectively.

There is claimed:

1. Device for producing tube bends of a given diameter and substantially uniform wall thickness from a straight tube having a diameter smaller than the given diameter, comprising means for re-shaping end portions of tube bends to form tengentially directed cylindrical leg extensions with equal tube bend cross sections, said re-shaping means being a fixed and a movable form tool surrounding the tube bend end, each of said form tools surrounding the tube bend end having half-cylindrical die cavities formed therein, a cluster of cylindrical pressure rollers disposed about an imaginary circle and insertable into the tube bend end, and a common drive for said rollers, said rollers being slideable along the axis of said extension.

2. Device according to claim 1, including a central support roller for said pressure rollers.

3. Device according to claim 2, including a support slideable along the leg extension relative to said pressure rollers, said support roller having a truncated-conical shape and being disposed in said support.

4. Device according to claim 3, wherein said pressure rollers have a truncated-conical shape at the leading ends thereof in insertion direction.

5. Device for producing tube bends of a given diameter and substantially uniform wall thickness from a straignt tube having a diameter smaller than the given diameter, comprising means for re-shaping end portions of tube bends to form tengentially directed cylindrical leg extensions with equal tube bend cross sections, said re-shaping means being three simultaneously operable pressure rollers disposed in vincinity of each other and being movable around the circumference of the tube bend end, one of said rollers being operable to re-shape the inner wall of the tube bend end and two of said rollers being operable to re-shape the outer wall of said tube bend end, the axis of rotation of said inner roller being disposed between the axes or rotation of said outer rollers.

6. Device according to claim 5, including axial shafts for driving said rollers and a rotatable motor-driven disc, said shafts being mounted to said disc.

7. Device according to claim 6, including eccentric bushings disposed between said shafts and said disc for varying the distance between said rollers.

8. Device according to claim 7, including a drive shaft for said rotatable disc and a hingeable clamping device for aligning the axis of the tube bend end and by extension with said drive shaft.

9. Device for performing the method of producing tube bends of a given diameter and substantially uniform wall thickness from a straight tube having a diameter smaller than the given diameter, comprising means for re-shaping end portions of tube bends to form tengentially directed cylindrical leg extensions with equal tube bend cross sections, said re-shaping means being forming tools for working inside and outside of the tube end, said forming tools being operable over a given path and having a given shape so as to form a cylindrical surface with said forming tools over said given path and wherein said given path is cylindrically directed, said re-shaping means including two semi-cylindrical pressure jaws surrounding the periphery of the tube bend end and a tool extending into the tube end, one pressure jaw being fixed and the other pressure jaw being movable up and down, and including a mandrel insertable within the tube bend end and a semi-circular punch integral with said movable pressure jaw.

10. Device for performing the method of producing tube bends of a given diameter and substantially uniform wall thickness from a straight tube having a diameter smaller than the given diameter, comprising means for re-shaping end portions of tube bends to form tengentially directed cylindrical leg extensions with equal tube bend cross sections, said re-shaping means being forming tools for working inside and outside of the tube end, said forming tools being operable over a given path and having a given shape so as to form a cylindrical surface with said forming tools over said given path and wherein said forming tools are cylindrically shaped, said re-shaping means including two semi-cylindrical pressure jaws surrounding the periphery of the tube bend end and a tool extending into the tube bend end, one pressure jaw being fixed and the other pressure jaw being movable up and down, and including a mandrel insertable within the tube bend end and a semi-circular punch integral with said movable pressure jaw.

11. Device for performing the method of producing tube bends of a given diameter and substantially uniform wall thickness from a straight tube having a diameter smaller than the given diameter, comprising means for re-shaping end portions of tube bends to form tengentially directed cylindrical leg extensions with equal tube bend cross sections, said re-shaping means being forming tools for working inside and outside of the tube end, said forming tools being operable over a given path and having a given shape so as to form a cylindrical surface with said forming tools over said given path and wherein said given path is cylindrically directed, said re-shaping means including two pressure jaws, one of said pressure jaws being fixed and having a dish-shaped recess formed therein corresponding to the shape of half of the outer surface of a finished tube bend, the other of said pressure jaws being movable and having a dish-shaped recess formed therein corresponding to half of the inner surface of a finished tube bend, and protrusion means integral with said movable pressure jaw and insertable into the tube bend end.

12. Device for performing the method of producing tube bends of a given diameter and substantially uniform wall thickness from a straight tube having a diameter smaller than the given diameter, comprising means for re-shaping end portions of tube bends to form tengentially directed cylindrical leg extensions with equal tube bend cross sections, said re-shaping means being forming tools for working inside and outside of the tube end, said forming tools being operable over a given path and having a given shape so as to form a cylindrical surface with said forming tools over said given path and wherein said forming tools are cylindrically shaped, said re-shaping means including two pressure jaws, one of said pressure jaws being fixed and having a dish-shaped recess formed therein corresponding to the shape of half of the outer surface of a finished tube bend, the other of said pressure jaws being movable and having a dish-shaped recess formed therein corresponding to half of the inner surface of a finished tube bend, and protrusion means integral with said movable pressure jaw and insertable into the tube bend end.

* * * * *